US005236171A

United States Patent [19]

Holmquist

[11] Patent Number: 5,236,171

[45] Date of Patent: Aug. 17, 1993

[54] LOAD SUPPORTING LINKAGE WITH GAS SPRING

[75] Inventor: Roland Holmquist, Vingaker, Sweden

[73] Assignee: Krister Borgh, Bromma, Sweden

[21] Appl. No.: 763,697

[22] Filed: Sep. 23, 1991

[30] Foreign Application Priority Data

Nov. 7, 1990 [SE] Sweden ..... 9003539

[51] Int. Cl.[5] ..... F16M 13/00

[52] U.S. Cl. ..... 248/584; 248/575; 248/591; 248/595; 267/113

[58] Field of Search ..... 248/575, 584, 591, 595, 248/592, 284; 108/145, 144; 297/345, DIG. 10; 267/118, 120, 113, 136

[56] References Cited

U.S. PATENT DOCUMENTS

| | | | |
|---|---|---|---|
| 1,714,244 | 5/1929 | Rowley | 108/145 X |
| 2,531,880 | 11/1950 | Herring | 108/145 X |
| 2,728,621 | 12/1955 | Kempter | 108/145 X |
| 2,982,050 | 5/1961 | May | 108/145 X |
| 3,041,060 | 6/1962 | Jacobsen | 248/284 X |
| 3,572,828 | 3/1971 | Lehner | 248/584 X |
| 4,312,491 | 1/1982 | Aondetto | 248/575 |
| 4,597,565 | 7/1986 | Smith | 267/120 X |
| 4,640,488 | 2/1987 | Sakamoto | 108/145 X |
| 4,682,749 | 7/1987 | Strater | 248/284 |
| 4,712,653 | 12/1987 | Franklin et al. | 108/145 X |
| 4,880,201 | 11/1989 | Hall et al. | 248/575 |
| 4,898,103 | 2/1990 | Pontoppidan et al. . | |

FOREIGN PATENT DOCUMENTS 444258 4/1986 Sweden .

*Primary Examiner*—Blair M. Johnson
*Attorney, Agent, or Firm*—Young & Thompson

[57] ABSTRACT

Mechanism for movably supporting a load, comprises a fixed frame, a pendulum lever pivotally connected at one end to the frame, and a link pivotally connected at one end to the other end of the pendulum lever. The other end of the link is connected to a vertically movable load support. A gas spring is pivotally interconnected between the frame and the link at points spaced from the points of articulation of the link and pendulum lever to the frame and to each other. Provision is made for adjusting the position of the pivotal connection between the link and the gas spring lengthwise of the link, and for adjusting the position of the pivotal connection of the gas spring to the frame in a direction toward or away from the point of articulation of the pendulum lever to the frame. Guides for the load are provided, comprising rollers mounted on the frame in between which a vertical member slides vertically. The vertical member at its upper end supports the load and at its lower end is articulately interconnected to the link.

3 Claims, 2 Drawing Sheets

LOAD SUPPORTING LINKAGE WITH GAS SPRING

FIELD OF THE INVENTION

The present invention relates to a load supporting linkage with a gas spring, and more particularly to such a mechanism which eliminates pressure variations in the gas spring during its stroke, so as to modify the movement of the linkage in such a way as to provide continuous compensation for the loss of pressure in the gas spring.

BACKGROUND OF THE INVENTION

Many practical applications are known for gas springs. The advantage of a gas spring is that it is able to store potential energy without the use of weights or counterweights. Common fields of application for gas springs are, for example, in chairs, desk tops, workbenches and the doors of vehicles.

OBJECTS OF THE INVENTION

It is accordingly a principal object of the present invention to provide such a mechanism wherein fluctuating lifting characteristics of the gas spring during its stroke and the continuous change in length of the effective lever arms is compensated.

Another object of the present invention is to provide such a mechanism which is easy to adjust depending on the supported weight and/or the friction of the lever mechanism, to the end that the load supported by the linkage behaves as though it were weightless over all of its path of movement.

Still another object of the present invention is to provide such a mechanism in combination with a supported weight which permits rectilinear stepless adjustment of the position of the load in a vertical direction.

SUMMARY OF THE INVENTION

These objects are achieved according to the present invention by providing a stationary frame to which a pendulum lever is articulately attached, and wherein a link is pivotally connected to the free end of the pendulum lever. The other end of the link is pivotally connected to a load carrier which is guided for vertical movement. A gas spring is pivotally interconnected between the link and the frame at a distance from the points of attachment of the pendulum lever to the frame and to the link. The effective length of the lever relative to the gas spring can be changed, by adjusting the position of the articulated connection of the gas spring to the link, and also the position of the articulated connection between the gas spring and the frame.

BRIEF DESCRIPTION OF THE DRAWINGS

The above and other objects and advantages of the present invention will become apparent from a consideration of the following description, taken in connection with the accompanying drawings, in which.

DETAILED DESCRIPTION OF THE INVENTION

Figure 1:
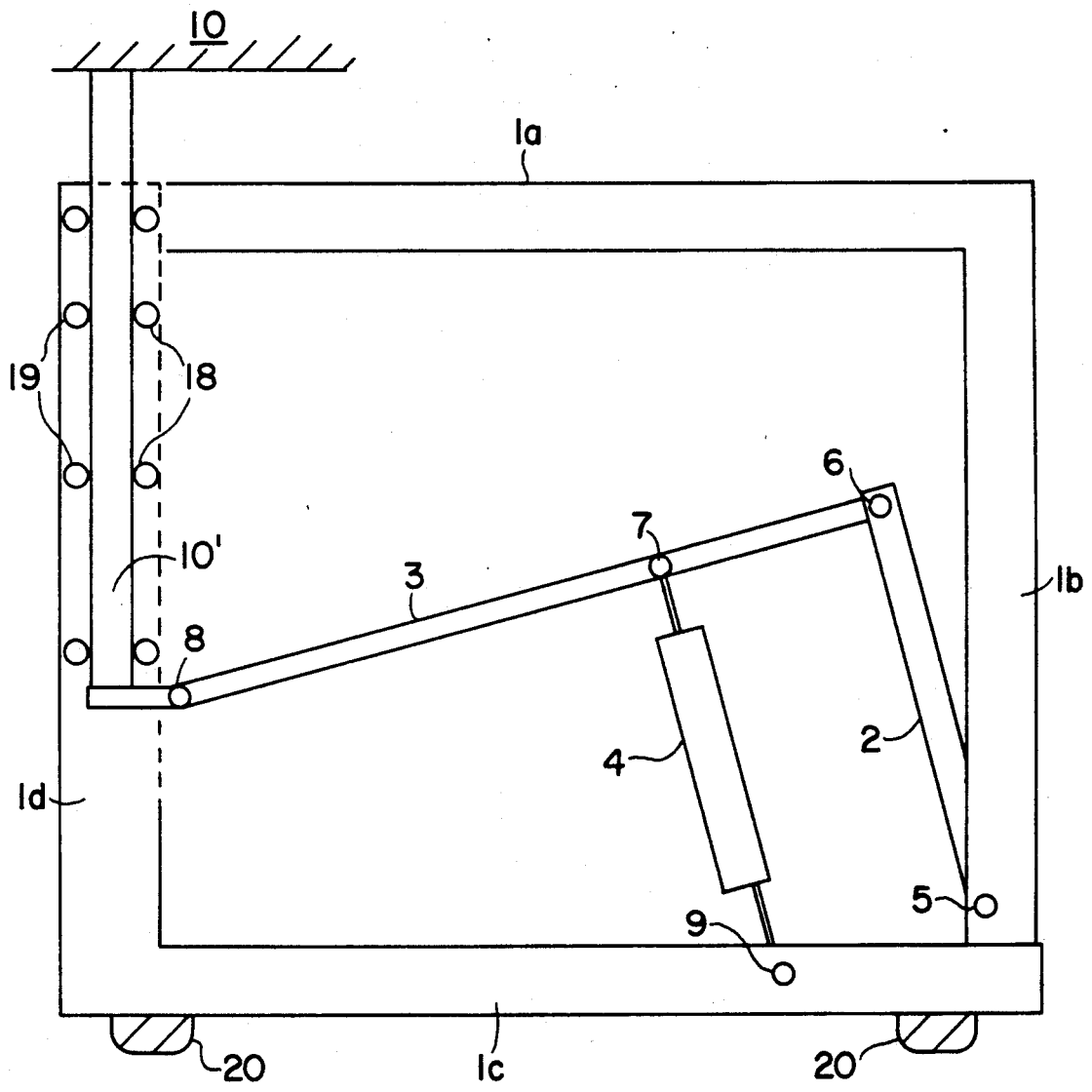
FIG. 1 is a schematic side view of a mechanism according to the invention.

Referring now to the drawings in greater detail, and first to FIG. 1 thereof, there is shown an apparatus according to the present invention, comprising a fixed frame comprised by frame portions 1*a*–1*d*. The fixed frame can be for example the base of a workbench. A load 10, shown as a bench top in FIG. 1, is supported by the linkage of the present invention.

A pendulum lever 2 is articulately connected at 5 to one of the lower corners of the frame. The free end of pendulum lever 2 is pivotally connected to a link 3 at 6. Link 3 is pivotally connected at its other end, at 8, to the lower end of a vertical member 10' which at its upper end is fixed to the load 10. Member 10' slides vertically to the frame between guide rollers 18, 19 mounted on frame portion 1*d*.

A gas spring 4 is pivotally connected at one end, at 7, to link 3 a distance from pivotal connections 6 and 8, and at its other end, at 9, to frame portion 1*c* at a distance from pivotal connection 5.

Figure 2A:
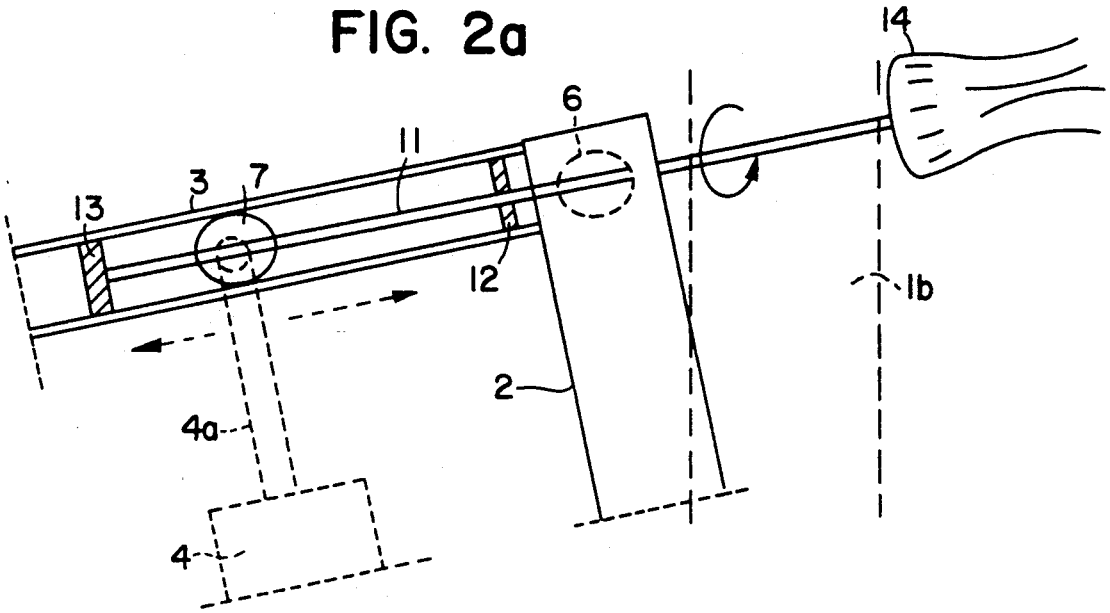
FIG. 2*a* is an enlarged schematic side view, partly in section, of the points of attachment of the link to the pendulum lever and to the gas spring.
Figure 2B:
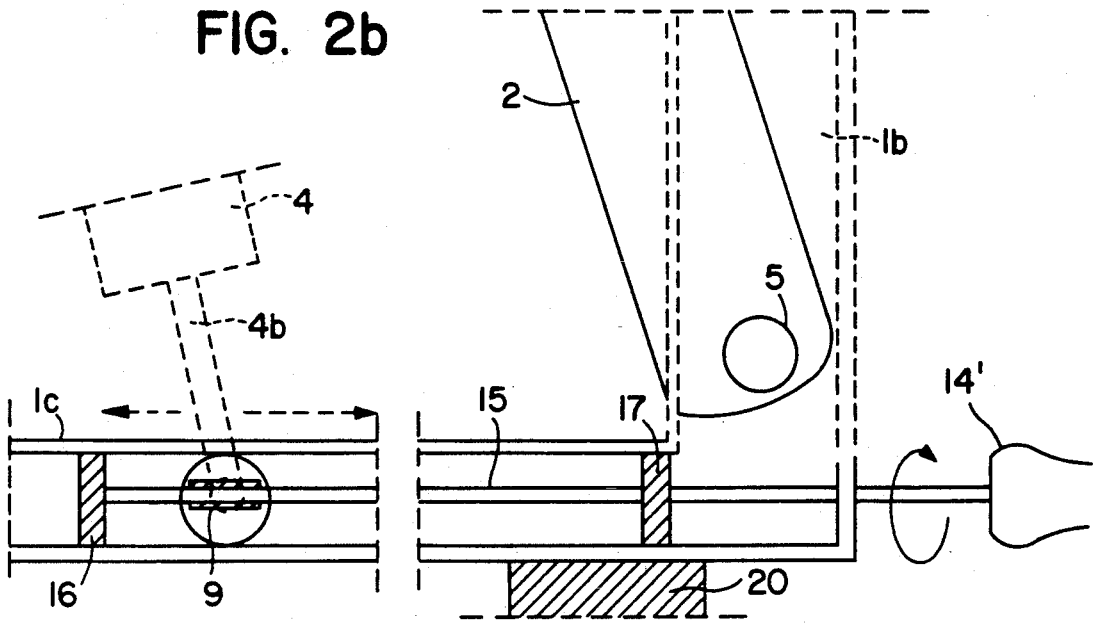
FIG. 2*b* is another enlarged schematic side view, partly in section, of the points of attachment of the pendulum lever to the frame and of the gas spring to the frame.

FIGS. 2*a* and 2*b* show the adjustability of the points of articulation 7 and 9 relative to the remainder of the structure.

In FIG. 2*a*, the pivotal connection 7 of the gas spring to link 3 is shown in greater detail. Specifically, the member providing connection 7 to a rod 4*a* of gas spring 4, has a threaded through hole in which a threaded rod 11 is screw threadedly received. Rod 11, in turn, is mounted in stationary supports 12 and 13 within link 3, and is rotatable within those supports without being axially movable relative to those supports. Rod 11 projects beyond support 12 to the right as seen in FIG. 2*a*, and is accessible through a hole in the upper end of lever 2 through which a tool 14 can be inserted so as to rotate rod Il in either direction, thereby to shift connection 7 lengthwise along link 3 in the corresponding direction.

Similarly, FIG. 2*b* shows a threaded rod 15 mounted for rotation on fixed supports 16 and 17 relative to which rod 15 can rotate without moving axially. Rod 15 is in screw-threaded relation with the member providing the pivotal connection 9 to a piston rod 4*b* of gas spring 4; and rod 15 extends to the right through support 17 as seen in FIG. 2*b*. There is a hole through frame 1 in alignment with rod 15, so that a tool 14' can be inserted to engage and rotate rod 15 in either direction, thereby to move connection 9 in either direction shown by the arrows in FIG. 2*b*.

FIGS. 1 and 2*b* show supports 20 for the frame 1.

In operation, upward or downward force applied to the load 10 will cause the linkage to deform, this deformation being resisted by gas spring 4 with a force such that, thanks to the arrangement of the parts as shown in FIG. 1, the resistance to vertical movement of the load 10 will be substantially constant over the path of movement of load 10.

To change the relationship of the articulated connections 7 and 9 of gas spring 4 relative to the linkage system, resort is had to the adjustments indicated in FIGS. 2*a* and 2*b*, respectively.

From a consideration of the foregoing disclosure, therefore, it is believed to be evident that the initially recited objects of the present invention have been achieved.

The invention is not restricted to the illustrated embodiment. Modifications and variations can be made within the scope of the appended claims.

What is claimed is:

1. Mechanism for movably supporting a load, comprising a fixed frame, a pendulum lever having two ends, the pendulum lever begin pivotally connected at one end to the frame, a link having two ends, the link being pivotally connected at one end tot he other end of the pendulum lever, the other end of the link being connected to a vertically movably load support, a gas spring pivotally interconnected between the frame and the link at points spaced from the points of articulation of the link and pendulum lever to the frame and each other, means for adjusting the position of the pivotal connection between the link and the gas spring lengthwise of the link, and means for adjusting the position of the pivotal connection of the gas spring to the frame in a direction toward or away from the point of articulation of the pendulum lever to the frame.

2. A mechanism as claimed in claim 1, and further including means on the frame for guiding movement of a load vertically relative to the frame.

3. A mechanism as claimed in claim 2 wherein said guide means confuse rollers mounted on the frame and between which a vertical member slides vertically, said vertically member at its upper end supporting the load and at its lower end being articulately interconnected to the link.

* * * * *